US006264367B1

(12) United States Patent
Slaughter, Jr. et al.

(10) Patent No.: US 6,264,367 B1
(45) Date of Patent: Jul. 24, 2001

(54) DUAL-SEAL DRILL BIT WITH FLUID CLEANING CAPABILITY

(75) Inventors: Robert H. Slaughter, Jr.; Roger Didericksen, both of Ponca City, OK (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/411,427

(22) Filed: Oct. 1, 1999

Related U.S. Application Data

(63) Continuation-in-part of application No. 08/980,935, filed on Dec. 1, 1997, which is a continuation-in-part of application No. 08/574,793, filed on Dec. 19, 1995, now abandoned.

(51) Int. Cl.[7] ..... E21B 10/22

(52) U.S. Cl. ..... 384/94; 175/371

(58) Field of Search ..... 384/92, 93, 94, 384/95; 175/371; 277/336, 362, 380

(56) References Cited

U.S. PATENT DOCUMENTS

| | | | |
|---|---|---|---|
| 2,960,313 | 11/1960 | Goodwin | 255/308 |
| 3,268,018 | 8/1966 | Neilson | 175/318 |
| 3,476,446 | 11/1969 | Neilson | 308/8.2 |
| 3,746,405 | 7/1973 | Welton | 308/8.2 |
| 3,921,735 | 11/1975 | Dysart | 175/337 |
| 3,990,525 | 11/1976 | Penny | 175/337 |
| 4,092,054 | 5/1978 | Dye | 308/8.2 |
| 4,102,419 | 7/1978 | Klima | 175/371 |
| 4,168,868 | 9/1979 | Shields | 308/8.2 |
| 4,176,848 | 12/1979 | Lafuze | 277/92 |
| 4,179,003 | 12/1979 | Cooper et al. | 175/371 |
| 4,183,417 | 1/1980 | Levefelt | 175/339 |
| 4,200,343 | 4/1980 | Highsmith | 308/8.2 |
| 4,249,622 | 2/1981 | Dysart | 175/227 |
| 4,252,330 | 2/1981 | Crow | 277/92 |
| 4,253,710 | 3/1981 | Goodman | 308/8.2 |
| 4,256,351 | 3/1981 | Langford, Jr. | 308/8.2 |
| 4,277,109 | 7/1981 | Crow | 308/8.2 |
| 4,284,310 | 8/1981 | Olschewski et al. | 308/8.2 |
| 4,375,242 | 3/1983 | Galle | 175/228 |
| 4,427,307 | 1/1984 | Norlander et al. | 384/93 |
| 4,453,836 | 6/1984 | Klima | 384/94 |
| 4,515,228 | 5/1985 | Dolezal et al. | 175/313 |
| 4,552,233 | 11/1985 | Klima | 175/371 |
| 4,629,338 | 12/1986 | Ippolito | 384/94 |

(List continued on next page.)

FOREIGN PATENT DOCUMENTS

| | | |
|---|---|---|
| 574515 | 9/1976 | (FR) . |
| 2019921 | 11/1970 | (GB) . |
| 2045315 | 10/1980 | (GB) . |
| 2045838 | 11/1980 | (GB) . |
| 641062 | 11/1977 | (SU) . |

OTHER PUBLICATIONS

Photographs of 15 inch MXM dual deal drill bit Manufactured by Superior Rock Bit Company, Virginia, Minn. And obtained by Applicant on May 23, 1996; (12 p.).

*Primary Examiner*—Thomas R. Hannon
(74) *Attorney, Agent, or Firm*—Conley, Rose & Tayon, P.C.

(57) ABSTRACT

A drill bit for use in an earthen annulus that contains loose particles is connected to a fluid supply source and includes a bit body having at least one journal segment and at least one fluid conduit in fluid communication with the fluid supply source. A roller cone is rotatably mounted upon the journal segment and forms at least one bearing cavity therebetween. Annular primary and secondary seals are disposed between the roller cone and the bit body and between the bearing cavity and the earthen annulus. An air groove is provided around at least a portion of the cone or leg between the primary seal and the earthen annulus. The groove circumscribes less than the entire circumference of the groove or leg, and in preferred embodiments includes an exit port and/or a diversion plug. Both the exit port and the diversion plug help prevent the groove from becoming plugged with debris.

41 Claims, 9 Drawing Sheets

U.S. PATENT DOCUMENTS

| | | | |
|---|---|---|---|
| 4,641,976 | 2/1987 | Kar | 384/95 |
| 4,657,091 | 4/1987 | Higdon | 175/229 |
| 4,688,651 | 8/1987 | Dysart | 175/371 |
| 4,722,404 | 2/1988 | Evans | 175/371 |
| 4,722,615 | 2/1988 | Bailey et al. | 384/96 |
| 4,756,631 | 7/1988 | Jones | 384/95 |
| 4,762,189 | 8/1988 | Tatum | 175/371 |
| 4,793,719 | 12/1988 | Crockett et al. | 384/92 |
| 4,838,365 | 6/1989 | Kotch | 175/371 |
| 4,875,532 | 10/1989 | Langford, Jr. | 175/371 |
| 4,880,068 | 11/1989 | Bronson | 175/369 |
| 4,934,467 | 6/1990 | Langford, Jr. | 175/371 |
| 4,955,440 | 9/1990 | Chavez | 175/371 |
| 4,981,182 | 1/1991 | Dysart | 175/71 |
| 5,016,719 | 5/1991 | White | 175/353 |
| 5,027,911 | 7/1991 | Dysart | 175/57 |
| 5,056,610 | 10/1991 | Oliver et al. | 175/371 |
| 5,360,076 | 11/1994 | Kelly, Jr. et al. | 175/371 |
| 5,402,858 | 4/1995 | Quantz et al. | 175/371 |
| 5,441,120 | 8/1995 | Dysart | 175/228 |
| 5,452,771 | 9/1995 | Blackman et al. | 175/353 |
| 5,513,711 | 5/1996 | Williams | 175/57 |
| 5,513,715 | 5/1996 | Dysart | 175/371 |
| 5,518,077 | 5/1996 | Blackman et al. | 175/353 |

10
14
12
30
20
28
20
21
21
18
16
76
19

DUAL-SEAL DRILL BIT WITH FLUID CLEANING CAPABILITY

CROSS-REFERENCE TO RELATED APPLICATIONS

This is a continuation-in-part application of U.S. patent application Ser. No. 08/980,935, filed Dec. 1, 1997 and entitled "Sealed Bearing Drill Bit with Dual-Seal Configuration and Fluid Cleaning Capability," which is a continuation-in-part application of U.S. patent application Ser. No. 08/574,793, filed Dec. 19, 1995, and entitled "Seal Protection for Sealed Bearing Rotary Cone Rock Bits," now abandoned both of which are incorporated by reference herein in their entireties. The present application also incorporates the disclosure of U.S. patent application Ser. No. 08/982,081, U.S. Pat. No. 6,033,117 filed Dec. 1, 1997, in its entirety.

STATEMENT REGARDING FEDERALLY SPONSORED RESEARCH OR DEVELOPMENT

Not applicable.

FIELD OF THE INVENTION

The present invention relates generally to sealed bearing earth boring drill bits, such as rotary cone rock bits that utilize a fluid circulation medium. More particularly, the invention relates to such drill bits that have a dual seal arrangement for protecting internal bearing elements. Still more particularly, the present invention relates to a groove that allows pressurized drilling fluid to flow out from between a roller cone and its associated axle so as to optimize performance of the bit.

BACKGROUND OF THE INVENTION

During earth-drilling operations it is common to use a sealed bearing rotary cone drill bit. One common drill bit for use in an earthen annulus includes a bit body having at least one leg, the leg having at least one journal segment. A roller cone is rotatably mounted upon the leg journal segment and forms at least one bearing cavity therebetween. An annular primary seal is disposed between the leg and roller cone and is capable of sealing the bearing cavity. An annular secondary seal is disposed between the leg and roller cone and between the annular primary seal and the earthen annulus. The annular secondary seal is capable of substantially preventing the ingress of debris from the earthen annulus to the annular primary seal.

It is necessary to protect the bearing elements of the bit from contamination in order to sustain bit operability. In particular, it is desirable to isolate and protect the bearing elements of the bit, such as bearings, lubricant and bearing surfaces from earthen cuttings, mud and other debris in the drilling environment. Introduction into the bearing system of such contaminants leads to deterioration of the lubricant, bearings and bearing surfaces, causing undesirable wear and premature bit failure.

It is well known in the art to provide an annular seal around the bearing elements so as to prevent external contaminants from entering the bit through the annular opening and gap formed between each leg and its corresponding cone. These single seal arrangements, however, are known to be susceptible to leakage and premature wear due, for example, to the intrusion and abrasive effect of particles entering through the annular opening. When the single seal fails, the bearing elements become contaminated.

Dual seal arrangements have been developed that have an annular outer seal disposed around a primary inner seal for providing a second layer of protection against particles entering the annular opening. Generally, the outer seals of many prior art dual seal arrangements have provided insufficient protection around the primary seal. When the outer seal fails and allows particles or other contaminants to the primary seal, contamination of the bearing elements can occur as described above. Furthermore, various prior art dual seal arrangements require additional components or internal mechanisms that are susceptible to malfunction and/or increase the complexity of the bit and its manufacturing process.

Attempts have been made to prevent particles from entering the annular opening by directing pressurized drilling fluids, such as air, from within the drill bit out through the annular opening between the leg and cone. U.S. Pat. No. 4,102,419 discloses a rock bit with an inner metal sealing ring and a set of outer hardened mating surfaces between the leg and cone. Fluid is directed from inside the bit, past the inner metal sealing ring and the outer mating surfaces, and out through the annular opening so as to flush cuttings or other debris away from the inner seal. If the exiting fluid flow decreases or ceases, however, the outer mating surfaces may not effectively prevent the ingress of particles to the inner metal sealing ring due to the relative movement between the cone and leg during cone misalignment, thus exposing the inner metal sealing ring to contamination. Hence, for example, if the flow of drilling fluid is turned off during a pause in drilling operations, the particles generated during drilling will fall to the bottom of the hole, where the bit is likely to be sitting. Since there is no fluid flow out of the gap, there is a high probability that some particles will find their way into the annular gap.

It has also been proposed to include a groove in the cone between the inner primary seal and the annular opening. This groove directs fluid from inside the bit out through the annular opening to prevent the entry of particles from the borehole. U.S. Pat. Nos. 4,453,836 and 5,513,711 disclose variations on this concept. Nevertheless, the groove is subject to the same disadvantages, inasmuch as particles that enter the groove during time of reduced fluid flow tend to become trapped in the groove.

Hence, it is believed that the sealed bits of the prior art have significant disadvantages, and there remains a need for more effective configurations for protecting the bearing components of a sealed bearing rotary cone drill bit.

BRIEF SUMMARY OF THE INVENTION

In accordance with the present invention, an air groove is provided around part of the circumference of the interface between the leg and the cone. The air groove may preferably include one or more exit ports located at various positions. The exit port can be a drilled hole or can be an extension of the groove, either of which allows passage of particles from the groove to the outer surface of the bit leg. The air groove may also include a diversion plug positioned so as to mechanically dislodge or divert particles from the backface of the cone. The diversion plug can be energized or non-energized, and can be made from a variety of materials. If the groove includes an air exit port, it is preferred that the diversion plug be positioned in the groove. Alternatively, the plug can be located outside the air groove, virtually anywhere on the cone backface. Regardless of where it is positioned, the diversion plug cleans the backface.

The present invention comprises a combination of features and advantages that enable it to substantially advance the technology associated with sealed bearing drill bits. While the appended claims are not limited to the characteristics and advantages of the present invention described herein as well as additional features and benefits, various exemplary features of the invention will be readily apparent to those skilled in the art upon reading the following detailed description and referring to the accompanying drawings.

BRIEF DESCRIPTION OF THE DRAWINGS

For a detailed description of the preferred embodiments of the invention, reference will now be made to the accompanying drawings wherein.

DETAILED DESCRIPTION OF THE INVENTION

Figure 1:
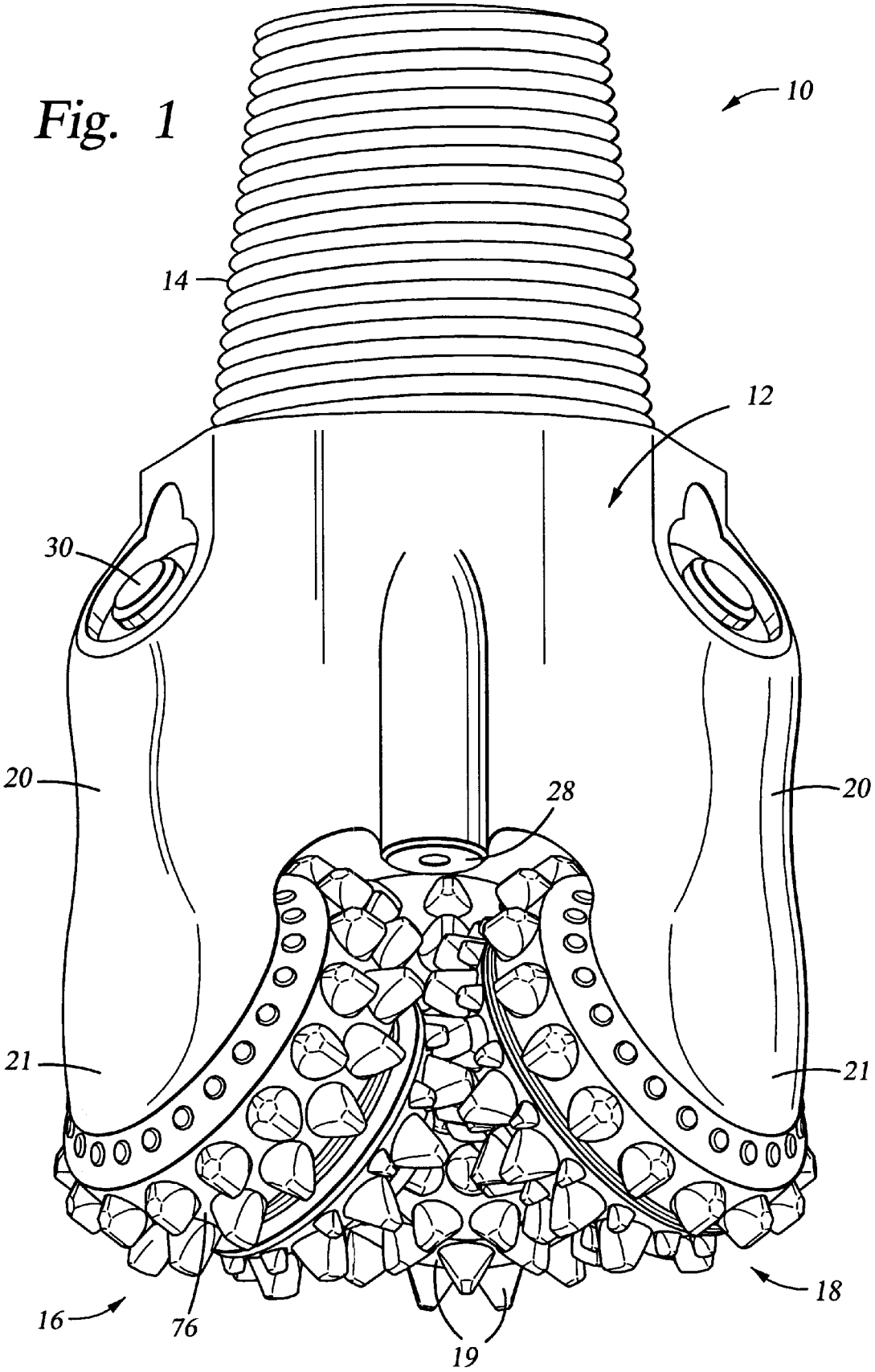
FIG. 1 is a perspective view of a sealed bearing rotary cone drill bit made in accordance with the present invention.

Presently preferred embodiments of the invention are shown in the above-identified figures and described in detail below. In illustrating and describing the preferred embodiments, like or identical reference numerals are used to identify common or similar elements. The figures are not necessarily to scale and certain features and certain views of the figures may be shown exaggerated in scale or in schematic form in the interest of clarity and conciseness.

Figure 2:
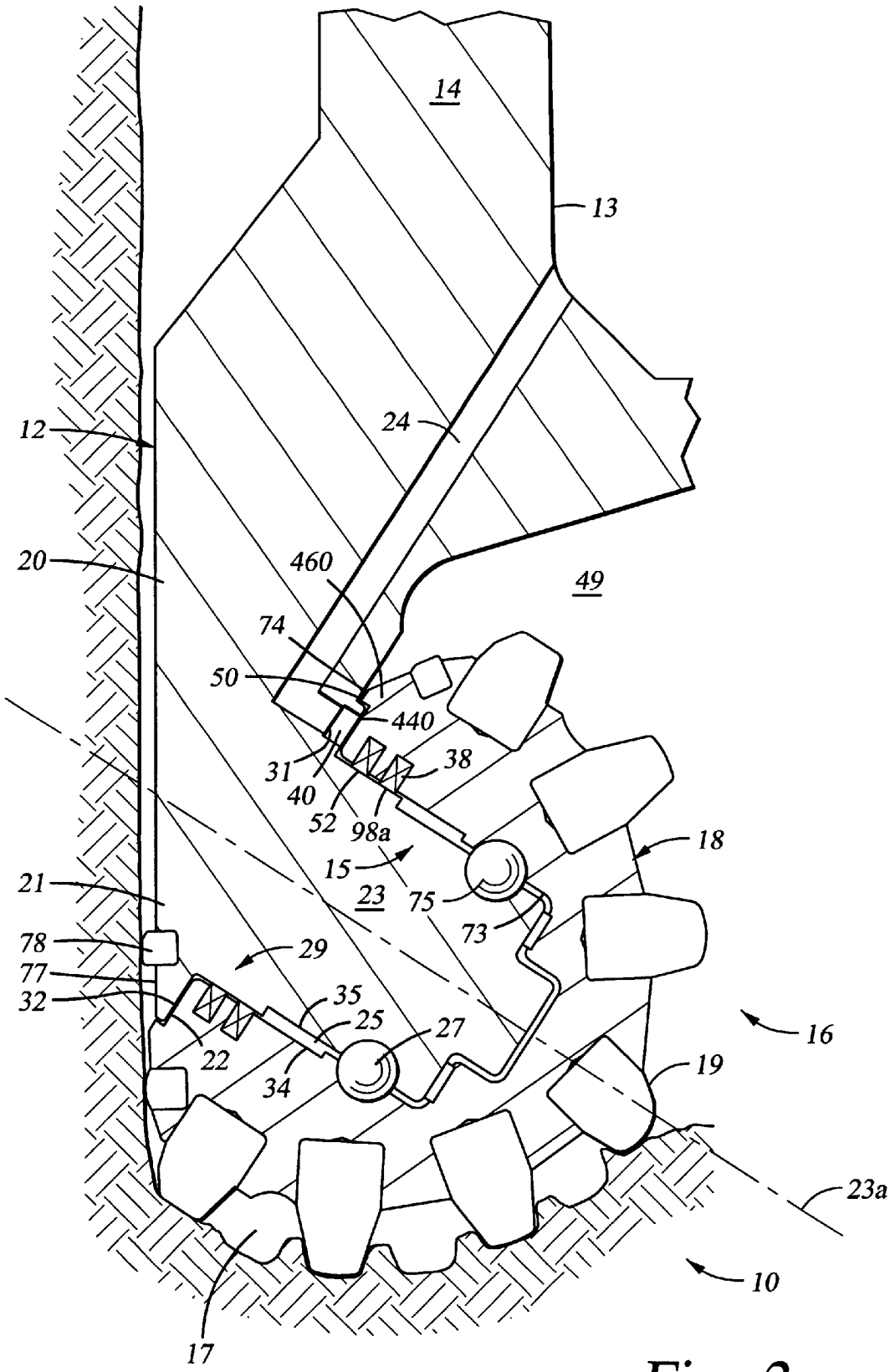
FIG. 2 is a cross-sectional view of one leg of the rotary cone drill bit of FIG. 1 having a dual seal arrangement and a partial air groove in accordance with the present invention.

Referring initially to FIGS. 1 and 2, a sealed-bearing earth boring rotary cone rock bit 10 is shown in an earthen annulus, or borehole 17 (FIG. 2). Although the present invention is described in terms of a rotary cone rock bits 10, it may similarly be used in other types of sealed bearing earth boring drill bits. Bit 10 includes a bit body 12, a threaded pin end 14 and a cutting end 16. Legs 20 extend from bit body 12 toward the cutting end 16 of the bit 10. At the cutting end 16, each leg 20 carries a cutter cone 18. Typically, rotary cone drill bits have three legs 20 and three cones 18, although the present invention may be used in bits 10 with any number of leg/cone combinations.

It should be understood that while the following description of the preferred embodiments of the present invention is made, in part, with reference to a single leg 20, cone 18 and corresponding features, but applies equally to each leg 20 and cone 18 of the bit 10. Referring to FIG. 2, each cone 18 is rotatably mounted on a journal segment 23 of the leg 20, with the journal segment 23 extending into the bore 73 of the cone 18. The journal segment 23 has a central axis 23*a*. The backface of cone 18 abuts a shirttail portion 21 of leg 20. At this interface, the adjacent cone backface surface 32 and leg backface surface 22 define a gap 50 that extends between the leg 20 and cone 18 to the exterior 49 of the bit 10. The gap 50 communicates with borehole 17 at an annular opening 74. Preferably, the bit is configured with the gap 50 having a generally uniform width, although a uniform width is not necessary for operation of the invention.

Referring now to FIG. 2, any suitable drill bit bearing system 15 can be used to permit the rotation of the cone 18 about the journal segment 23 during drilling operations. The bearing system can include various bearing elements. For example, the friction bearing system 15 of FIG. 2 includes cone bearing surfaces 34, journal bearing surfaces 35, friction bearing sleeve 25 and locking balls 27, disposed in one or more bearing cavities 75 formed between the cone 18 and journal 23, or in the bore 73 of the cone 18. A lubricant, such as grease (not shown), is provided to the bearing system 15 via a conventional lubricant reservoir system 30 (not shown).

It should be understood that a roller bearing system, such as the roller bearing system disclosed in U.S. Pat. No. 5,793,719 to Crockett et al., which is incorporated herein by reference in its entirety, may alternatively be used with the present invention instead of a friction bearing system 15. The term "bearing" as used generally herein includes roller bearings and friction bearings. It is noteworthy that conventional friction bearing systems, as compared with roller bearing systems 15, generally possess better load bearing capabilities and allow more space within the bit 10 for the placement of a bearing system seal arrangement 29 as will be described below.

Still referring to FIG. 2, a plenum 13 is formed in the bit body 12 in communication with the pin end 14 of the bit 10 and supplies circulation fluid to one or more nozzles 28 (FIG. 1). A circulation fluid, such as air, water, drilling mud or other fluids, such as are known in the art, flows into bit 10 from a fluid supply source (not shown) through a supply conduit, such as a drill pipe (not shown), that is attached to the pin end 14 of the bit 10, also as known in the art. Nozzles 28 operate to direct pressurized fluid against the bottom of borehole 17 so as to lift earthen cuttings and other debris up through borehole 17 to the surface (not shown). Nozzles 28 also direct the circulation fluid across the exterior 76 of the cones 18 and cutters 19 to dislodge debris accumulating thereabout.

The existence of earthen cuttings, mud and other debris in the borehole 17 and throughout the drilling environment makes it imperative that the bearing system 15 be effectively protected from contact with such debris. Ingress of such debris into the bearing system leads to deterioration of the lubricant and bearing system elements, such as friction bearing sleeve 25 and bearing surfaces 34, 35 which, in turn, leads to premature bit failure. An air groove in accordance with the present invention, and as described in detail below, with or without an exit port or diversion plug, protects the bearing system 15, thus assisting in sustaining operability of the bit 10.

Still referring to FIG. 2, primary and secondary seals 38, 52, respectively, are each preferably positioned between the cone and the journal so as to prevent passage of fluid or particles from the borehole into the bearing cavity. According to one preferred embodiment, the annular primary seal 38 is an absolute seal around the bearing cavities 75. The term "absolute" seal as used herein means a fluid tight seal, or allowing no fluid passage, by a seal subjected to normal wear and tear and operating under typical pressure conditions. The annular secondary seal 52 may also be an absolute seal, and is preferably capable at least of substantially preventing the ingress of debris and particles from the borehole into the bit. The secondary seal 52 may be placed either between the cone 18 and the leg 20 or between the cone 18 and the journal segment 23.

Generally, each seal 38 and 52 is situated in the bit 10 such that it is capable of providing a static seal against an energizing surface of one component at a "static seal interface," the seal 38, 52 generally having little or no movement relative to that component. A dynamic seal is generally formed at a "dynamic sliding seal interface" between each seal 38, 52 and the other energizing surface (of a different bit component) that each seal 38, 52 primarily engages. The surface of each seal 38, 52 forming the dynamic sliding seal interface is referred to as the "dynamic sealing surface" and the energizing surface of the bit component forming the dynamic sliding seal interface is referred to as the "contact surface." Though not essential, the contact surfaces may be formed with special hard metal welded inlays, such as nickel carbide weld rod, or have a separate mating ring formed of a hard material, such as tungsten carbide, so as to provide a better wear resistant surface.

Figure 3:
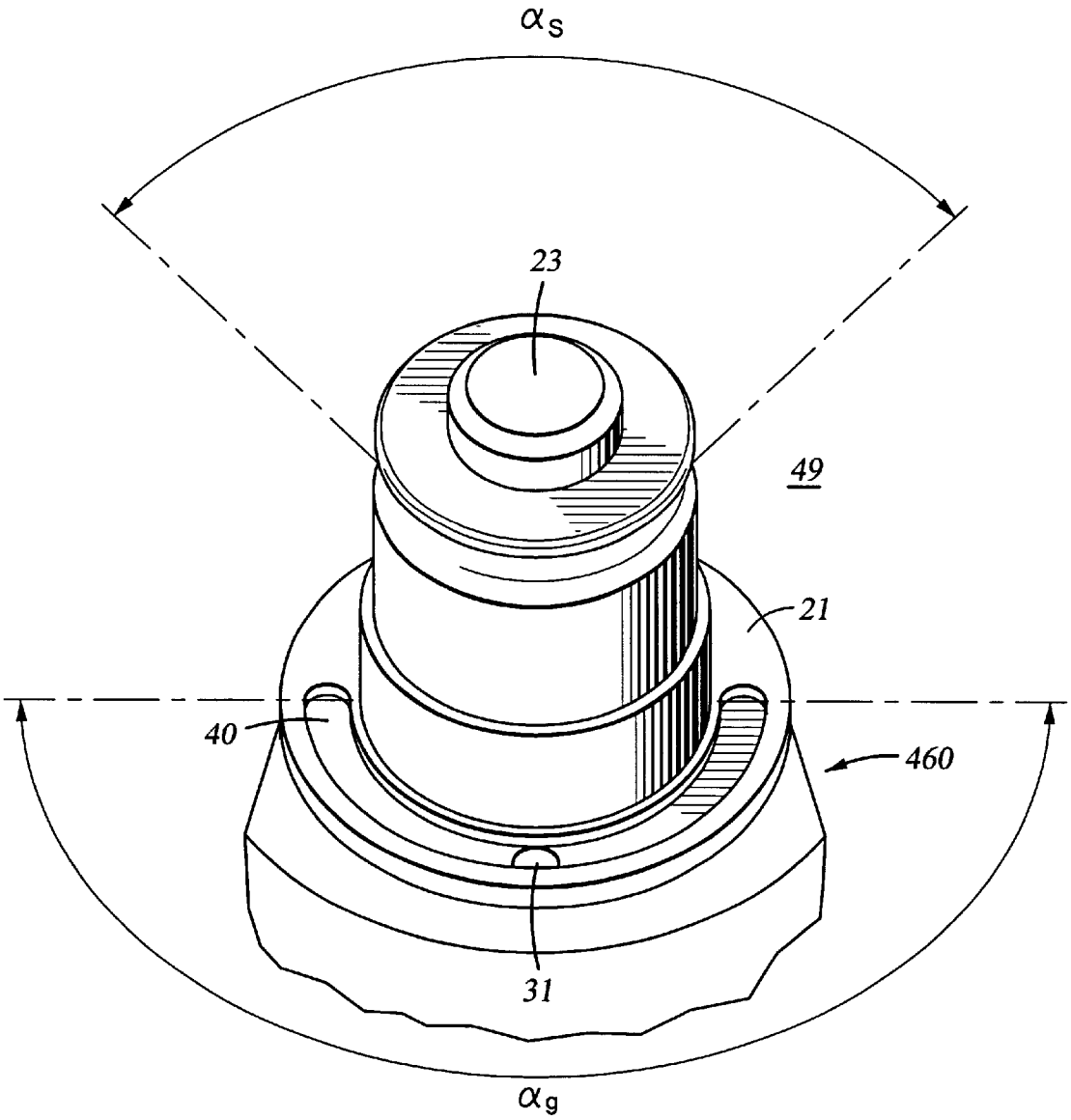
FIG. 3 is a perspective view of the journal segment of the leg shown in FIG. 2.

Referring still to FIGS. 2 and 3, in accordance with one preferred embodiment of the invention, a passage 24 is included in the bit body 12 to facilitate the flow of pressurized fluid, such as air, from the plenum 13 (FIG. 2) into the gap 50. The pressurized fluid flows out of gap 50 through annular opening 74 to the exterior 49 of the bit 10 to help prevent particles from entering the borehole 17. According to a preferred embodiment, a groove 40 is provided to facilitate the flow of fluid to gap 50. Groove 40 can be a channel formed in cone 18, leg 20, or journal segment 23. In an alternative embodiment, described below, an interstice 40*a* (FIGS. 6 and 7) can be defined between cone 18 and leg 20 instead of groove 40. It will be understood that references hereinafter to a "groove" are intended to include and encompass interstices, and vice versa, unless otherwise indicated. Each passage 24 terminates at a fluid entry port 31. Although multiple ports are not necessary for operation of the present invention, they may be used to promote uniform distribution of pressurized fluid along the length of groove 40. This in turn promotes a uniform flow of fluid out through the gap 50, particularly along the length of groove 40.

According to an alternative embodiment, fluid entry ports 31 communicate directly with the groove or interstice that contains the secondary seal 52. In this case, the groove or interstice that contains the secondary seal is in fluid communication with the gap 50 and is preferably disposed between the primary seal 38 and the opening 74.

In any case, fluid flowing through the fluid entry ports 31 and into the gap 50 is preferably substantially isolated from the primary seal 38. Importantly, during a decrease or cessation of pressurized fluid flow through the passage 24 and fluid entry port 31, the secondary seal 52 of various embodiments of the present invention will continue to prevent debris from coming into contact with the primary seal 38.

Referring now to FIG. 3, it has been found that certain advantages can be gained from providing an air groove that does not extend around the entire circumference of the cone. Hence, according to one preferred embodiment, groove 40 is configured so that it circumscribes between 90 and 300 degrees, and preferably between about 180 and 270 degrees, around the circumference of the cone 18 or leg journal 23 as shown in FIG. 3. The groove 40 need not have a uniform shape or cross-section, and can be formed in any desired shape that is compatible with one or more aspects of the invention. According to one preferred embodiment, groove 40 is positioned such that its azimuthal extent (as determined relative to the cone axis) does not include the azimuthal position of the longest portion of the shirttail 21. This avoids the reduction in mass of the shirttail that would otherwise occur. For example, as illustrated in FIG. 3, the approximate azimuthal extent of shirttail 21 is labeled $\alpha_s$, while a preferred azimuthal extent for groove 40 is labeled $\alpha_g$.

The use of a partial groove instead of a circumferential groove provides better fluid dynamics around that portion of the gap 50 that lies adjacent to the groove. In addition, use of a partial groove 40 allows the mass of the shirttail portion 21 to be maintained. A reduction in the mass of shirttail 21 may weaken shirttail 21 and increase its susceptibility to fracture or erosion during use. Because shirttail 21 generally protects primary seal 38 and bearing system 15, fracture to or erosion of the shirttail 21 can lead to the ingress of contaminants to the primary seal 38 and bearing system 15. Further, as illustrated in FIGS. 4–7, formation of a partial groove 40 (shown with a conventional, non-recessed shirttail in FIGS. 4–5) or partial interstice 40*a* (shown with a recessed shirttail in FIGS. 6–7) without reducing the mass of shirttail 21 permits the placement of additional wear protection, such as protective tungsten carbide inserts 78, in shirttail 21 closer to the edge 77 of shirttail 21 and set deeper into shirttail 21.

If desired, the bit 10 may be configured to have more than one partial groove 40 (not shown), each such partial groove 40 extending partially around the circumference of the leg journal 23 or cone 18 as desired. Similarly, it will be understood that any of the features described herein with respect to an air groove 40 can similarly be used in conjunction with an interstice 40*a*.

In further aspects of the invention, the fluid entry port(s) 31 can be disposed between the primary and secondary seals 38, 52. In this configuration, the secondary seal 52 may function as a one-way seal. For example, the seal 52 may be a non-perforated, one-way lip seal disposed between the fluid entry ports 31 and the opening 74. In this configuration, the lip of the seal allows the escape of pressurized fluid from the annular space between the seals when the pressure within interstice 98*a* is greater than the pressure in the borehole, while otherwise substantially preventing any inflow of particles from the gap 50 to the primary seal 38. Alternatively, the secondary seal 52 may instead be used to provide a generally absolute seal between the fluid entry port 31 and the annular opening 74. In this configuration, the seal 52 can be a non-perforated O-ring seal, combination seal, rigid lip seal, or any other suitable type of annular seal.

Figure 4:
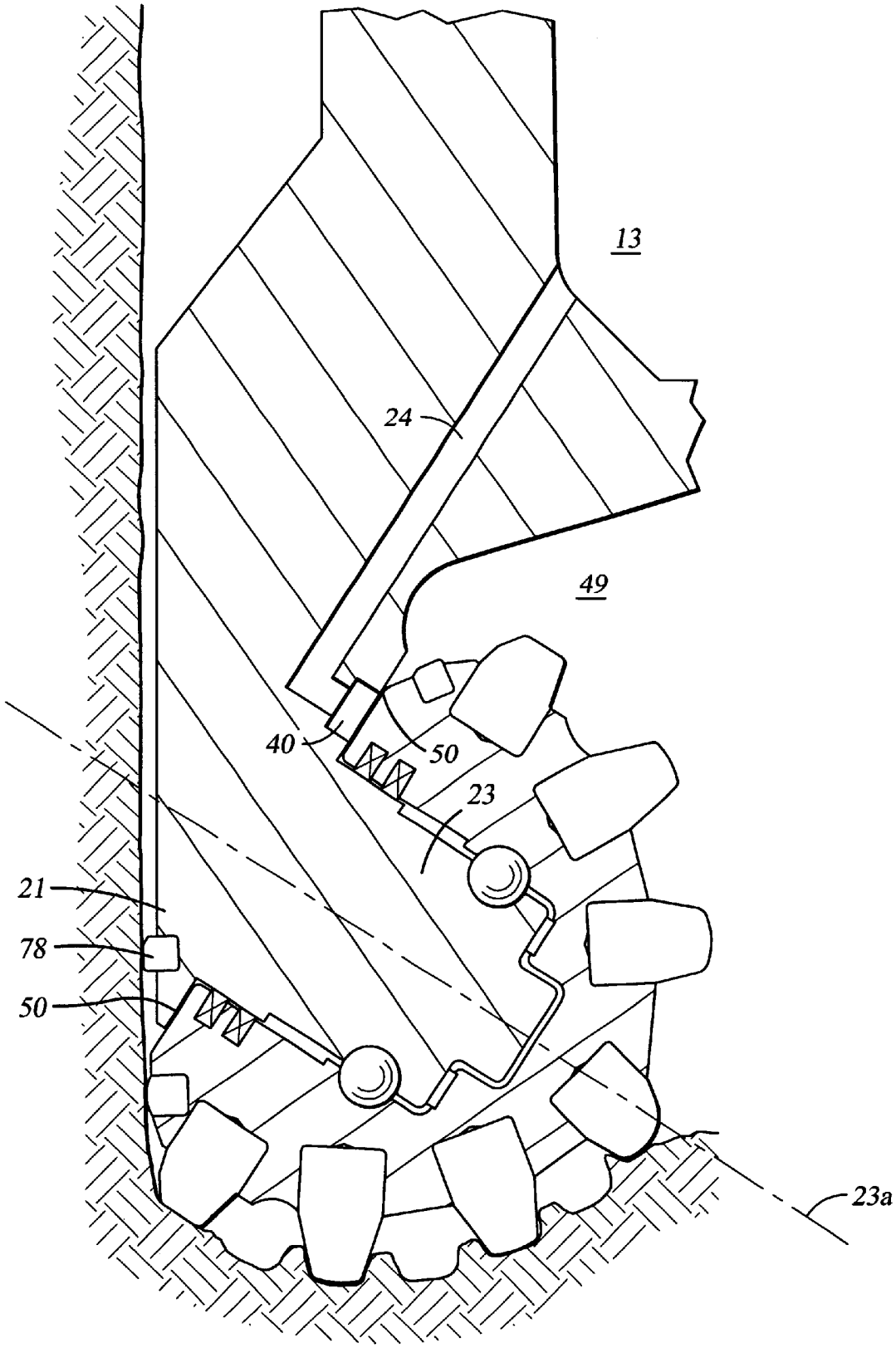
FIGS. 4 and 5 are cross-sectional and perspective views, respectively, of one leg of a rotary cone drill bit in accordance with a second alternative embodiment of the present invention, showing a partial air groove and a conventional shirttail.
Figure 5:
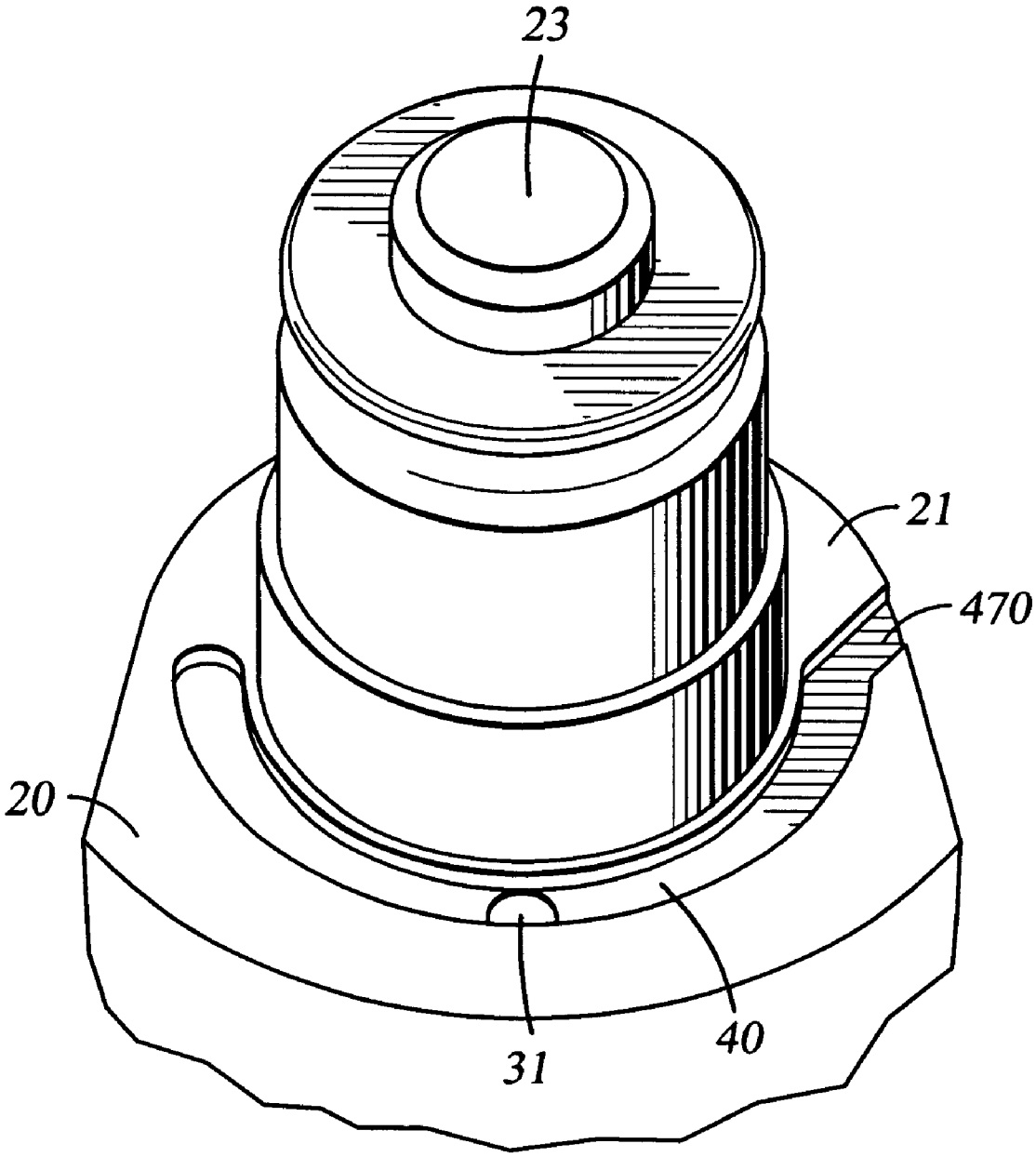

Referring now to FIGS. 4 and 5, in yet another embodiment of the invention, one or more fluid exit ports 470 provide fluid communication between groove 40 and the exterior of the bit 49. During operation of the bit, exit port 470 provides a passage for fluid flow out of groove 40. Exit port 470 preferably has a smallest cross-sectional dimension that is larger than the smallest cross-sectional dimension of the gap 50, and in some instances larger than the smallest cross-sectional dimension of the groove 40. Hence, exit port 470 allows the particles that would otherwise become trapped in the groove to exit and thereby reduces the likelihood that the groove 40 will become plugged. Similarly, exit port 470 can serve as a path for small and large particles to be flushed or blown out of passage(s) 24 and port(s) 31.

Fluid exit port(s) 470 can take any shape, form or orientation and can be used in any suitable bit configuration that allows fluid communication between the groove 40 and the borehole 17. For example, a single fluid exit port 470 is preferably formed on the trailing side of the bit leg so that material is not forced into the exit port during drilling operations. Exit port 470 can alternatively be on the leading side of the bit leg, or elsewhere on the leg, but these locations are not preferred because of the increased tendency of the port to become clogged with debris in those positions. Exit port 470 is preferably a sufficient distance from the input port to allow fluid to traverse at least most of the groove before exiting. For example, in one preferred embodiment, the fluid entry port 31 is preferably at one end of groove 40 and exit port 470 is preferably at the opposite end of groove 40 from entry port 31. Nevertheless, it will be understood that the position of each port can be adjusted as desired. In the example of FIG. 5, the shirttail portion 21 of the leg 20 is a conventional non-recessed shirttail, which can be formed to allow a direct path between the groove 40 and the bit exterior 49 through the fluid exit port 470.

Figure 6:
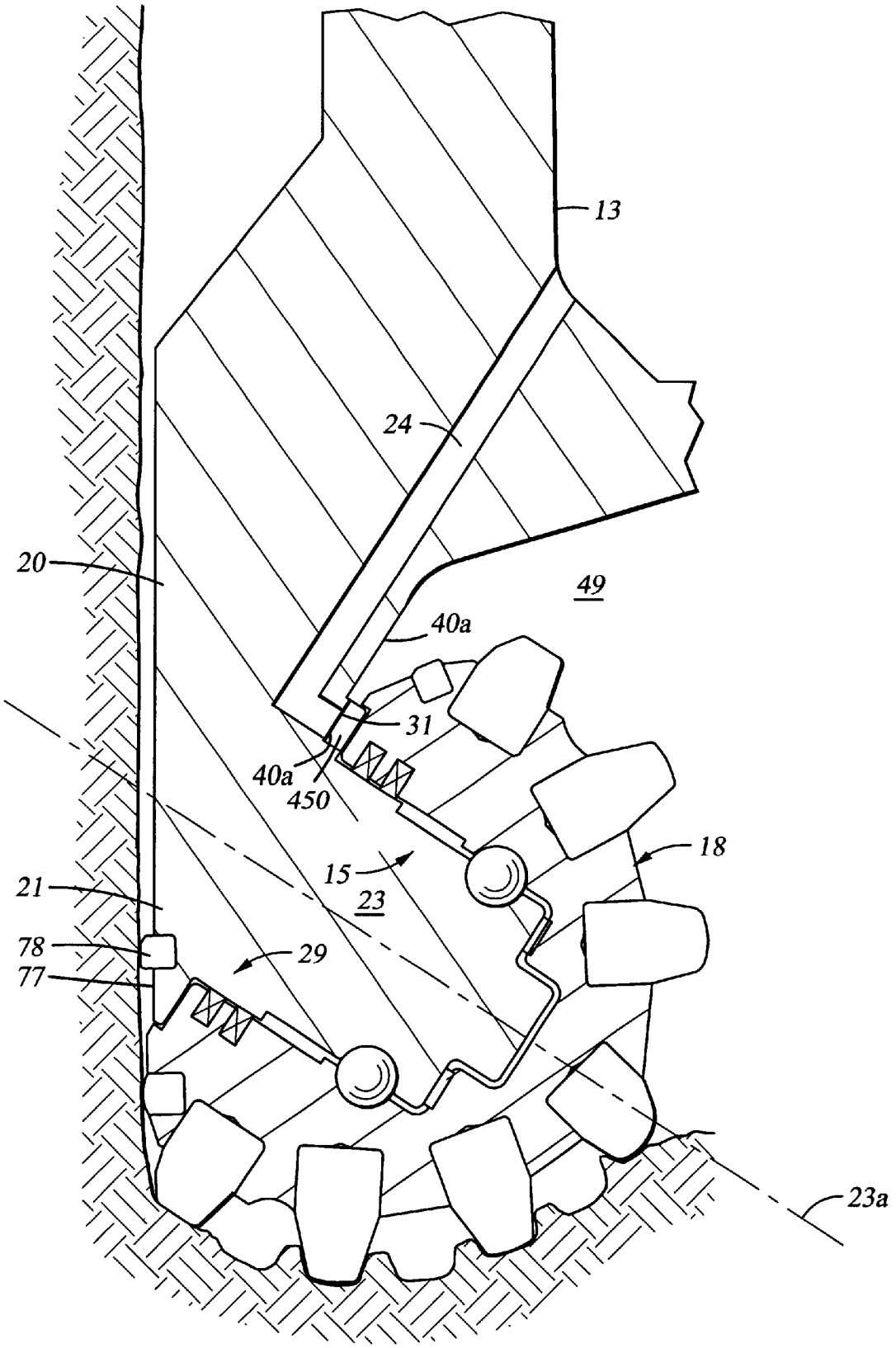
FIGS. 6 and 7 are cross-sectional and perspective views, respectively, of one leg of a rotary cone drill bit in accordance with a third alternative embodiment of the present invention, showing a partial air interstice with a recessed shirttail.
Figure 7:
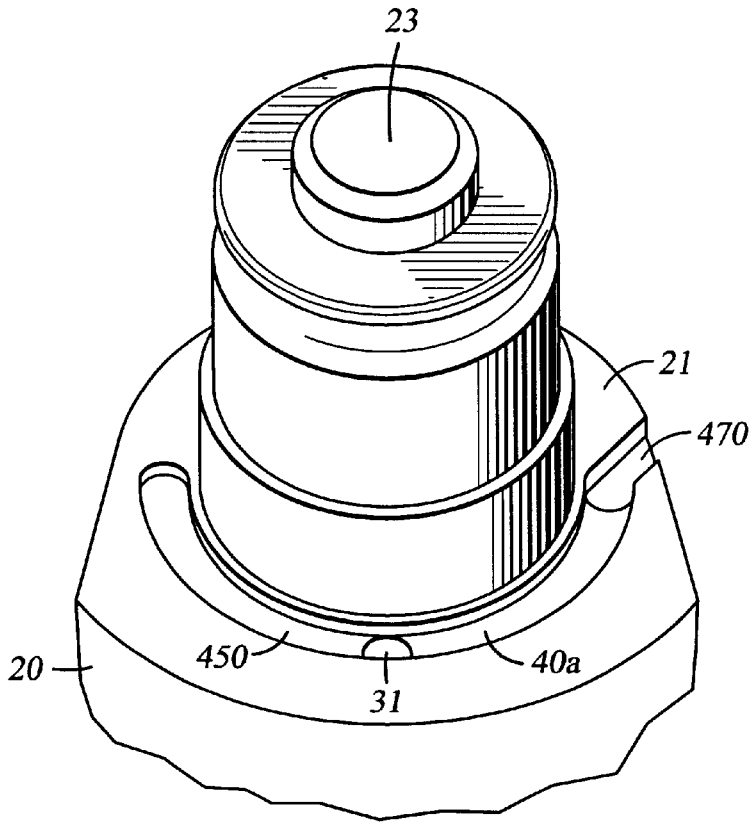
Figure 8:
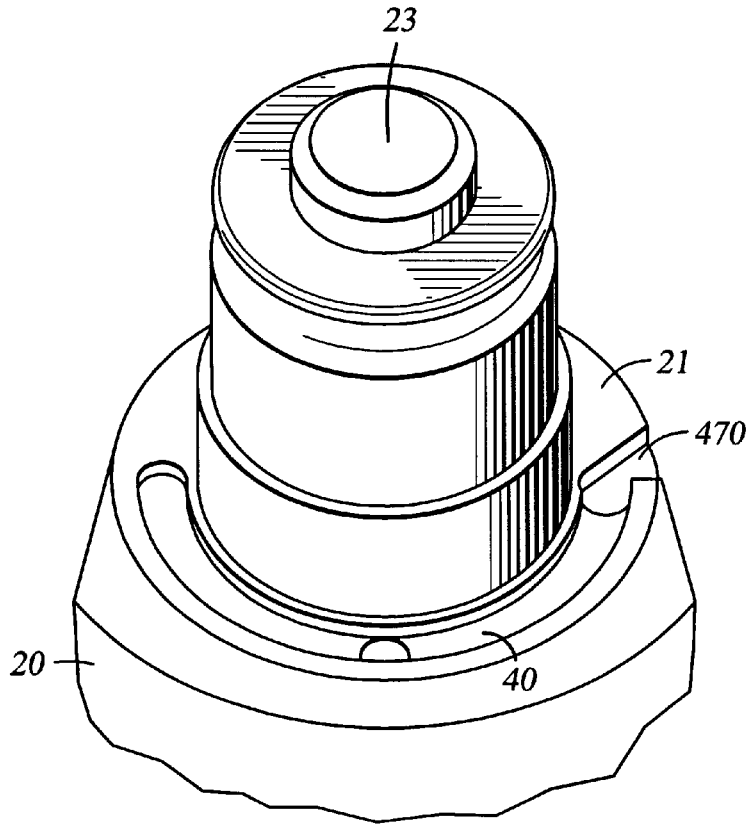
FIG. 8 is a perspective view of the journal segment of the leg of a first alternative embodiment of the present invention, showing a partial air groove with an exit port.

In another embodiment, the drill bit of FIGS. 6 and 7 includes a bit leg 20 and cone 18 combination having a fluid exit port 470 and a recessed shirttail portion 21. In the embodiment shown in FIGS. 6 and 7, an exit port 470 is used in combination with a partial interstice 450 in leg 20.

Figure 9:
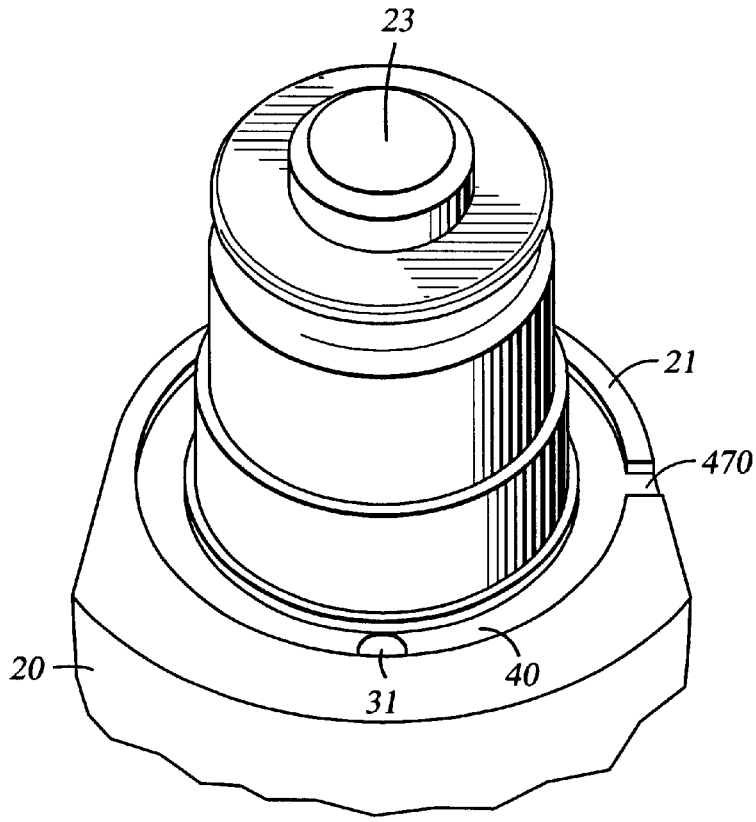
FIG. 9 is a perspective view of the journal of the leg of a fourth alternative embodiment of the present invention, showing an air exit in a full circumference air groove.
Figure 9A:
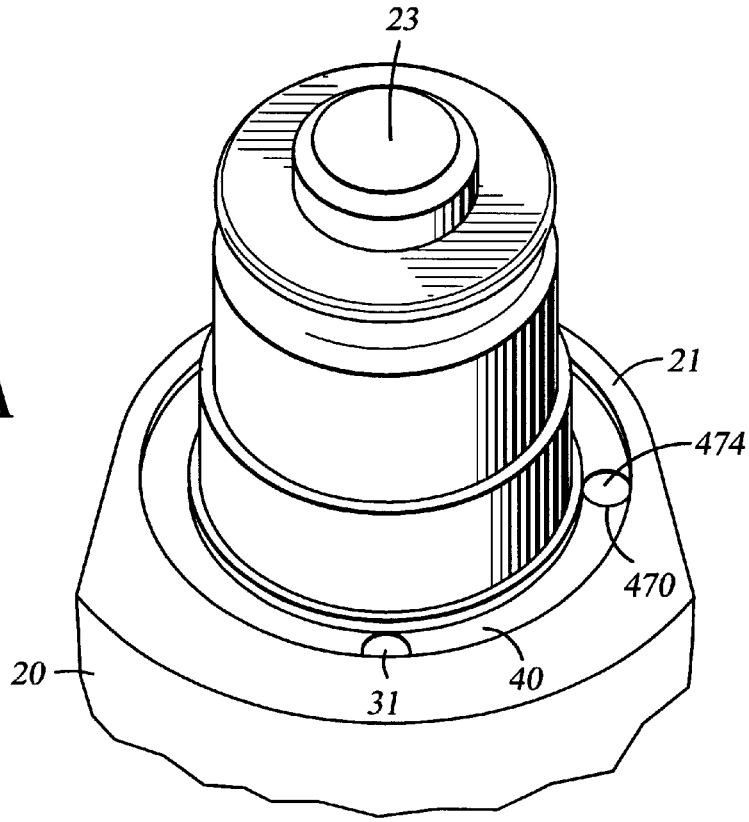
FIG. 9A is a perspective view of the journal of the leg of an alternative embodiment of the leg of FIG. 9, showing an air exit hole instead of an air exit port.

In yet other embodiment, shown in FIG. 9, an exit port 470 is used in communication with a full-circumference groove 40. Alternatively, and as shown in FIG. 9A, fluid exit port 470 can comprise a bore 474 extending from the groove 40 through the leg to the bit exterior 49. Bore 474 is shown formed in the bit leg 20, but can alternately be formed in the cone 18 (not shown) depending on the configuration of the groove 40 or interstice 40*a*.

Regardless of its location, exit port 470, can be any shape and can be disposed at any desired angle with respect to the leg backface. Hence, the flow path from groove 40 to the bit exterior 49 can be configured as desired. It should be understood that the present invention is not limited to any of the above configurations or particular combinations of features.

As is well known in the art, it is generally desirable to reduce the amount of frictional heat generated by bearing system seals to minimize heat related damage to the lubricant, seals and other bit components, and to promote bit longevity. In accordance with various embodiments of the present invention utilizing a fluid cleaning capability as described above, the flow of pressurized fluid through groove 40 helps to remove frictional heat generated by rotation of the cone on the leg.

The pressure inside groove 40, and hence the flow rate of the exiting fluid in the gap 50, can be controlled by controlling the supply fluid pressure with conventional means (not shown). Additionally, one or more flow control ports or pressure relieve devices (not shown) may be included in leg 20 to release excessive fluid pressure from the passage 24, though not necessary for operation of the present invention. Any combination of these and other factors may be varied to effect groove pressurization, while no single factor need necessarily be varied for operation of the present invention.

Figure 10:
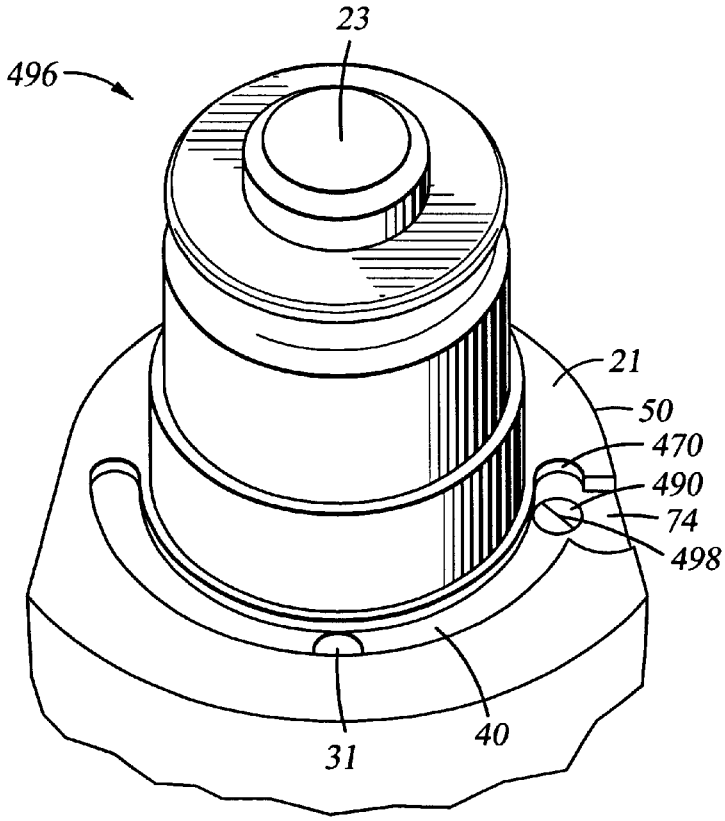
FIG. 10 is a perspective view of the journal of the leg of a fifth alternative embodiment of the present invention, showing an air exit port and a diversion plug.
Figure 11:
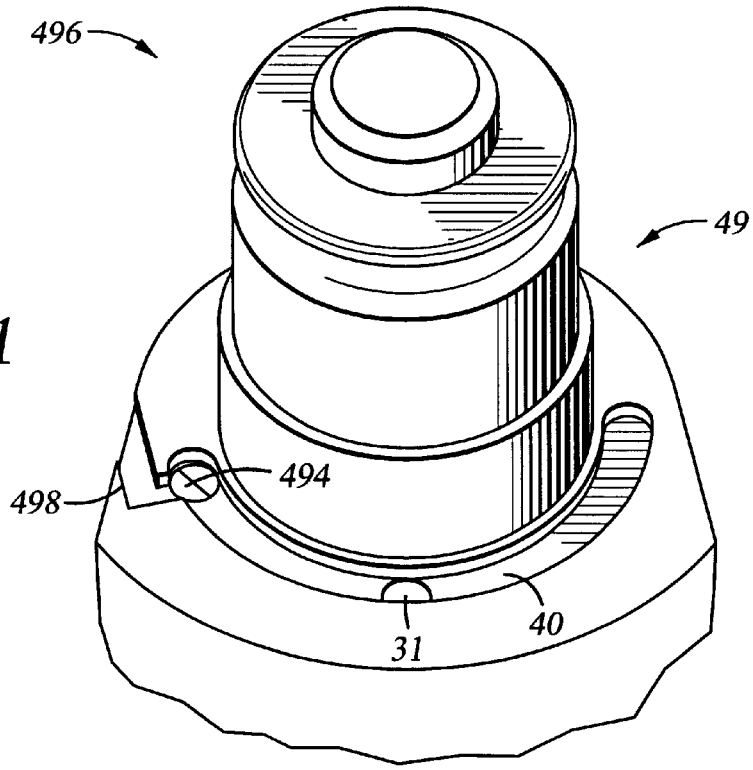
FIG. 11 is a perspective view of the journal of the leg of a sixth alternative embodiment of the present invention, showing a diversion plug.

In still a further aspect of the invention, referring to the embodiments shown in FIGS. 10 and 11, a diversion plug 490 may be included to assist in preventing the buildup of particles in the groove 40 or interstice 40*a* and plugging of the passage 24. Plug 490 is preferably received in a socket in leg 20. Diversion plug 490 may take any form, configuration and/or orientation, so long as the plug 490 extends into a space between the cone and the leg and is capable of impacting particles in groove 40 or from the bit exterior 49. Plug 490 of FIGS. 10 and 11 preferably comprises tungsten carbide, but can be any suitable, durable material. In a preferred embodiment, plug 490 comprises a cylindrical member having diversion ridge on its face and a tail or boss to keep it from turning in the socket.

If desired, plug 490 can be energized by including a biasing member in the socket below it, as shown in U.S Pat. No. 5,056,610, which is incorporated herein in its entirety. In other embodiments, plug 490 includes an energized or non-energized tungsten carbide member without a diversion slot. Any other member or device suitable for use in drill bit 10 and being capable of breaking up, loosening or diverting particles or debris from the groove 40 or interstice 40*a* can be used.

In the embodiments of FIGS. 10 and 11, the plug 490 is energized such that its top surface 494 bears on backface 32 of cone 18 (not shown). Plug 490 can be energized in any suitable manner, such as by a biasing member. Examples of suitable biasing members include, but are not limited to, a spring or elastomeric member that is held in compression by plug 490, which bears on backface 32. As the cone 18 rotates, such as shown with clockwise rotation arrow 496, the face 498 of the plug 490 will break-up, loosen or block the entry into groove 40 (or interstice 40*a*) of some, most or all debris or particles entering the opening 74, gap 50 or fluid exit port 470. Fluid flowing out of the groove 40 or interstice 40*a* will thereafter substantially wash, or evacuate, such debris or particles out of the bit 10.

Diversion plug 490 may be oriented in any suitable location and configuration. For example, the diversion plug 490 of FIG. 10 is located adjacent to the trailing side 500 of the leg 20. Further, the plug 490 can be used with a full circumference fluid cleaning groove 40 or interstice 40*a* (not shown), or a partial fluid cleaning groove 40 (FIGS. 10, 11) or interstice 450 (not shown) and with or without a fluid exit port 470 (FIGS. 10, 11).

Each of the foregoing aspects of the invention may be used alone or in combination with other such aspects and many aspects are interchangeable. The embodiments described herein are exemplary only and are not limiting of the invention, and modifications thereof can be made by one skilled in the art without departing from the spirit or teachings of this invention. Many variations of the embodiments described herein are possible and within the scope of the invention. Also, it is reiterated that all features of the present invention that are described herein with respect to a full or partial groove are contemplated to be used alternatively with a full or partial interstice. Accordingly, the scope of protection is not limited to the embodiments described herein.

What is claimed is:

1. A drill bit for use in an earthen annulus that contains loose particles, the drill bit connected to a fluid supply source, comprising:

a bit body having at least one leg, said leg having a journal segment, said bit body further having at least one fluid conduit in fluid communication with the fluid supply source;

a roller cone rotatably mounted upon said journal segment, at least one bearing cavity being defined between said cone and said bit body;

an annular primary seal disposed between said roller cone and said bit body and between said bearing cavity and the earthen annulus;

an annular gap disposed between said roller cone and said bit body and between said annular primary seal and the earthen annulus, said annular gap in fluid communication with said fluid conduit and the earthen annulus;

an annular secondary seal disposed between said annular primary seal and the earthen annulus; and at least one partial circumferential groove defined by at least one of said leg and said roller cone between said annular secondary seal and said annular gap and being in fluid communication with said fluid conduit and the earthen annulus, said partial groove circumscribing less than the entire circumference of at least one of said journal segment and said roller cone.

2. The drill bit according to claim 1 wherein said leg includes a shirttail and said shirttail includes an insert mounted therein.

3. The drill bit according to claim 1 wherein said leg includes a shirttail and said shirttail is recessed.

4. The drill bit according to claim 1 wherein said leg includes a shirttail and said shirttail is not recessed.

5. The drill bit according to claim 1 wherein said fluid conduit is between said secondary seal and said earthen annulus.

6. The drill bit according to claim 1 wherein said fluid conduit is between said primary and secondary seals.

7. The bit according to claim 1 wherein said groove circumscribes between 90 and 300 degrees.

8. The bit according to claim 1 wherein said groove circumscribes between 180 and 270 degrees.

9. The bit according to claim 1, further including at least one fluid exit port, said port having a smallest cross-sectional dimension that is greater than the smallest cross-sectional dimension of said gap.

10. The bit according to claim 1, further including at least one fluid exit port, said port having a smallest cross-sectional dimension that is greater than the smallest cross-sectional dimension of said groove.

11. The bit according to claim 10 wherein said exit port is positioned at one end of said groove.

12. The bit according to claim 1, further including a diversion plug positioned in one of said cone and said leg so as to scrape debris from the other of said cone and said leg.

13. The bit according to claim 12, further including at least one fluid exit port, said port having a smallest cross-sectional dimension that is greater than the largest cross-sectional dimension of said gap.

14. The bit according to claim 12, further including at least one fluid exit port, said port having a smallest cross-sectional dimension that is greater than the largest cross-sectional dimension of said groove.

15. The bit according to claim 1, further including a diversion plug positioned in one of said cone and said leg so as to scrape debris from the other of said cone and said leg, said diversion plug being reciprocably mounted and biased toward said other of said cone and said leg.

16. A drill bit for use in an earthen annulus that contains loose particles, the drill bit connected to a fluid supply source, comprising:

a bit body having at least one leg, said leg having a journal segment, said bit body further having at least one fluid conduit in fluid communication with the fluid supply source;

a roller cone rotatably mounted upon said journal segment and forming at least one bearing cavity therebetween;

an annular primary seal disposed between said roller cone and said bit body and between said bearing cavity and the earthen annulus;

an annular gap disposed between said roller cone and said bit body and between said annular primary seal and the earthen annulus, said annular gap in fluid communication with the earthen annulus; and an annular secondary seal disposed between said annular primary seal and the earthen annulus, a groove disposed between said annular primary seal and said annular gap and being in fluid communication with said fluid conduit and the earthen annulus, and a fluid exit port in fluid communication with said groove and the earthen annulus, said fluid exit port having a width, a depth and an area, said port having a smallest cross-sectional dimension that is greater than the smallest cross-sectional dimension of said gap.

17. The bit according to claim 16 wherein said groove circumscribes between 90 and 300 degrees.

18. The bit according to claim 16 wherein said groove circumscribes between 180 and 270 degrees.

19. The bit according to claim 16 wherein said groove circumscribes 360 degrees.

20. The bit according to claim 16 wherein said fluid exit port has a substantially round cross-section.

21. The bit according to claim 16 wherein said fluid exit port has a substantially rectangular cross-section.

22. The bit according to claim 16 wherein said fluid exit port is formed in said leg.

23. The drill bit according to claim 16 wherein said leg includes a shirttail and said shirttail is recessed.

24. The drill bit according to claim 16 wherein said leg includes a shirttail and said shirttail is not recessed.

25. The drill bit according to claim 16 wherein said exit port comprises a bore through a portion of said leg.

26. The bit according to claim 16 wherein said exit port is positioned at one end of said groove.

27. The bit according to claim 26, further including a diversion plug positioned in one of said cone and said leg so as to scrape debris from the other of said cone and said leg.

28. The bit according to claim 27 wherein said diversion plug is positioned proximal one end of said groove.

29. The bit according to claim 16, further including a diversion plug positioned in one of said cone and said leg so as to scrape debris from the other of said cone and said leg, said diversion plug being reciprocably mounted and biased toward said other of said cone and said leg.

30. A drill bit for use in an earthen annulus that contains loose particles, the drill bit being connected to a fluid supply source, comprising:

a bit body having at least one leg, said leg having a journal segment, said bit body further having at least one fluid conduit in fluid communication with the fluid supply source;

a roller cone rotatably mounted upon said journal segment, at least one bearing cavity being defined between said cone and said bit body;

an annular primary seal disposed between said roller cone and said bit body and between said bearing cavity and the earthen annulus;

an annular gap disposed between said roller cone and said bit body and between said annular primary seal and the earthen annulus, said annular gap in fluid communication with said fluid conduit and the earthen annulus;

an annular secondary seal disposed between said annular primary seal and the earthen annulus;

at least one groove defined by at least one of said leg and said roller cone between said annular secondary seal and said annular gap and being in fluid communication with said fluid conduit and the earthen annulus; and a diversion plug positioned in one of said cone and said leg so as to scrape debris from the other of said cone and said leg.

31. The bit according to claim 30 wherein said groove circumscribes between 90 and 300 degrees.

32. The bit according to claim 30 wherein said groove circumscribes between 180 and 270 degrees.

33. The bit according to claim 30 wherein said groove circumscribes 360 degrees.

34. The bit according to claim 30, wherein said diversion plug is reciprocably mounted and is biased toward said other of said cone and said leg.

35. The bit according to claim 30 wherein said diversion plug is positioned proximal one end of said groove.

36. The bit according to claim 30, further including at least one fluid exit port, said port having a smallest cross-sectional dimension that is greater than the smallest dimension of said groove.

37. The bit according to claim 30, further including at least one fluid exit port, said port having a smallest cross-sectional dimension that is greater than the smallest dimension of said gap.

38. A drill bit for use in an earthen annulus that contains loose particles, the drill bit connected to a fluid supply source, comprising:

a bit body having at least one leg, said leg having a journal segment, said bit body further including at least one fluid conduit in fluid communication with the fluid supply source;

a roller cone rotatably mounted upon said journal segment and forming at least one bearing cavity therebetween;

an annular primary seal disposed between said roller cone and said bit body and between said bearing cavity and the earthen annulus;

an annular gap disposed between said roller cone and said bit body and between said annular primary seal and the earthen annulus, said annular gap in fluid communication with said fluid conduit and the earthen annulus;

an annular secondary seal disposed between said annular primary seal and the earthen annulus;

at least one interstice defined between said leg and said roller cone between said annular primary seal and said annular gap and being in fluid communication with said fluid conduit and the earthen annulus, said partial interstice extending the entire circumference of at least one of said journal segment and said roller cone; and a fluid exit port in fluid communication with said interstice and the earthen annulus, said fluid exit port having a width, a depth and an area, said port having a smallest cross-sectional dimension that is greater than the smallest cross-sectional dimension of said groove.

39. The drill bit according to claim 38 wherein said interstice is between said secondary seal and said annular gap.

40. A drill bit for use in an earthen annulus that contains loose particles, the drill bit connected to a fluid supply source, comprising:

a bit body having at least one leg, said leg having a journal segment, said bit body further including at least one fluid conduit in fluid communication with the fluid supply source;

a roller cone rotatably mounted upon said journal segment and forming at least one bearing cavity therebetween;

an annular primary seal disposed between said roller cone and said bit body and between said bearing cavity and the earthen annulus;

an annular gap disposed between said roller cone and said bit body and between said annular primary seal and the earthen annulus, said annular gap in fluid communication with said fluid conduit and the earthen annulus;

an annular secondary seal disposed between said annular primary seal and the earthen annulus; and at least one partial interstice defined between said leg and said roller cone between said annular primary seal and said annular gap and being in fluid communication with said fluid conduit and the earthen annulus, said partial interstice extending around less than the entire circumference of at least one of said journal segment and said roller cone.

41. The drill bit according to claim 40 wherein said partial interstice is between said secondary seal and said annular gap.

* * * * *